US005474333A

United States Patent [19]

Schrader

[11] Patent Number: 5,474,333

[45] Date of Patent: Dec. 12, 1995

[54] WEATHERPROOF CLIPBOARD ASSEMBLY

[76] Inventor: Todd L. Schrader, 1110 S. Carl, Bolivar, Mo. 65613

[21] Appl. No.: 354,421

[22] Filed: Dec. 12, 1994

[51] Int. Cl.[6] ..... B42D 3/00

[52] U.S. Cl. ..... 281/45; 281/51

[58] Field of Search ..... 248/444.1; 281/28, 281/42, 45, 51; 402/4, 70, 73, 80 R; 24/67 R, 67.5

[56] References Cited

U.S. PATENT DOCUMENTS

| | | | |
|---|---|---|---|
| 1,642,384 | 9/1927 | Pryor | 281/45 |
| 1,642,385 | 9/1927 | Pryor | 281/45 |
| 1,967,632 | 7/1934 | Simonson | 281/45 |
| 2,685,638 | 8/1954 | Littrell | 281/51 X |
| 4,997,088 | 3/1991 | Spry | 281/45 X |

FOREIGN PATENT DOCUMENTS

| | | | |
|---|---|---|---|
| 2140350 | 11/1984 | United Kingdom | 281/51 |

*Primary Examiner*—Willmon Fridie, Jr.

[57] ABSTRACT

A weatherproof clipboard assembly wherein a housing has a transparent lid and an interior cavity permits the lid to be hingedly mounted to the housing permitting selective securement of a clipboard within the housing, such that a front wall of the housing includes an elastomeric resilient sleeve to permit secure engagement of an individual's hand in a waterproof securement of the individual's hand and arm permitting access interiorly of the housing for writing upon a clipboard selectively secured to the housing floor.

10 Claims, 4 Drawing Sheets

17
10
11
18
21
19
18
15
16

17
18
19
14
25
26
16
13
27

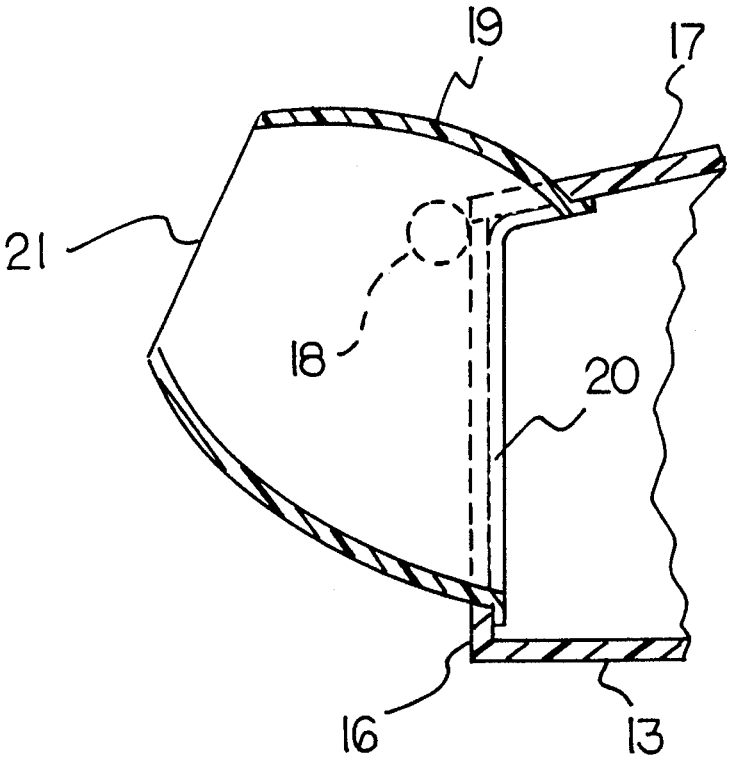
FIG 7
FIG 8
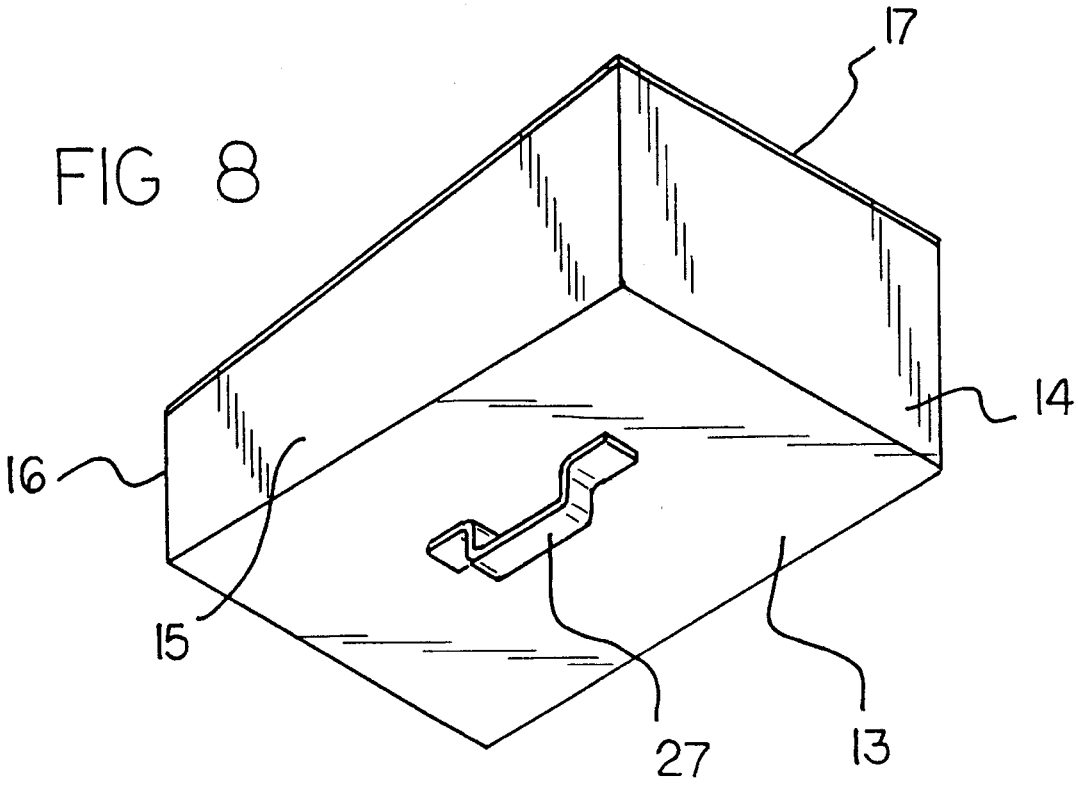

WEATHERPROOF CLIPBOARD ASSEMBLY

TECHNICAL FIELD

The field of invention relates to portable clipboard structure, and more particularly pertains to a new and improved weatherproof clipboard assembly permitting the user thereof to employ the invention with attendant waterproof shielding permitting its application during exposure to inclement weather.

BACKGROUND OF THE INVENTION

Various prior art clipboard structure has been employed having dual purposes such as indicated in the U.S. Pat. Nos. 4,919,037 and 4,442,780 where the clipboard functions as a ballistic shield structure.

The U.S. Pat. No. 4,892,334 sets forth a clipboard having a storage container integral therewith.

SUMMARY OF THE INVENTION

The weatherproof clipboard assembly of the invention is arranged to include a clipboard arranged for selective securement to a floor of a transparent housing, such that at least a pivoted top wall of the housing is transparent to permit viewing of the clipboard secured to the floor by utilization of magnetic or hook and loop fastener structure. The front wall of the housing includes a resilient elastomeric tube permitting a user to direct a hand therethrough providing for a weatherproof engagement of the hand relative to the interior cavity of the housing permitting writing upon the clipboard even when the housing is exposed to inclement weather conditions.

Objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 7 is an enlarged orthographic view, using the lines 7—7 of FIG. 3 in the direction indicated by the arrows.

FIG. 8 is an isometric bottom view of the invention.

DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
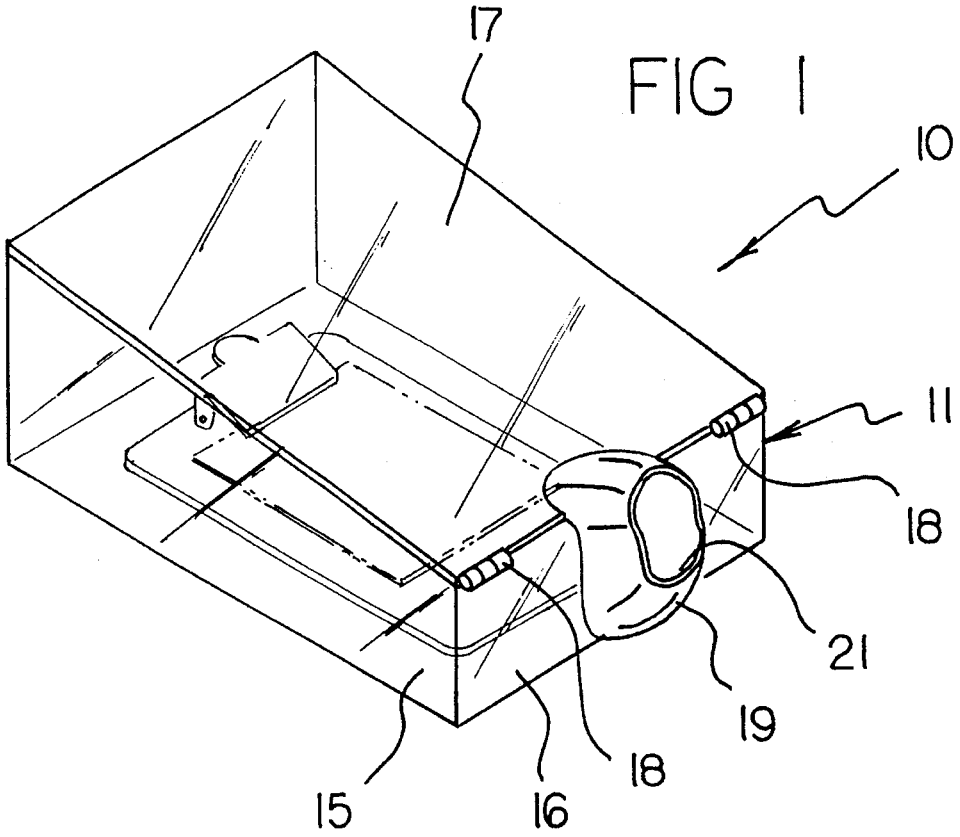
FIG. 1 is an isometric illustration of the invention.
Figure 2:
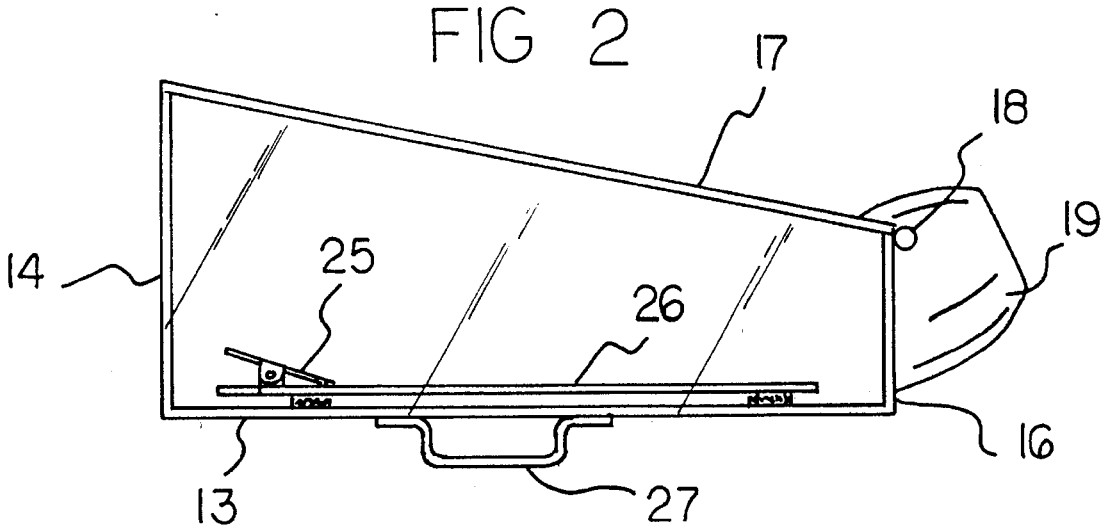
FIG. 2 is an orthographic side view of the invention.
Figure 3:
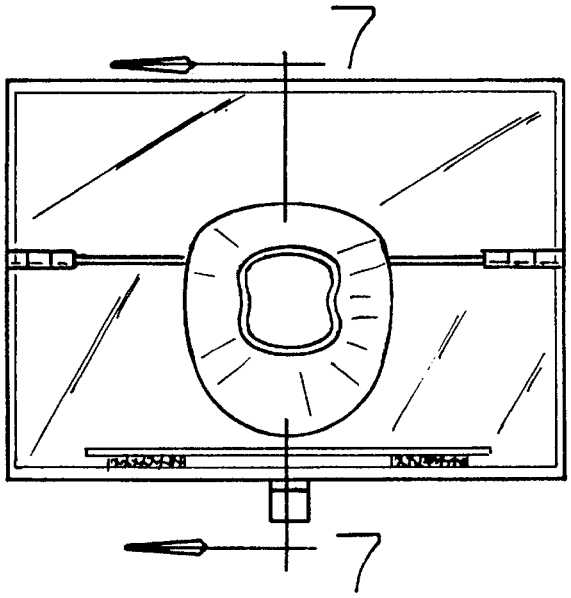
FIG. 3 is an orthographic frontal end view of the invention.
Figure 4:
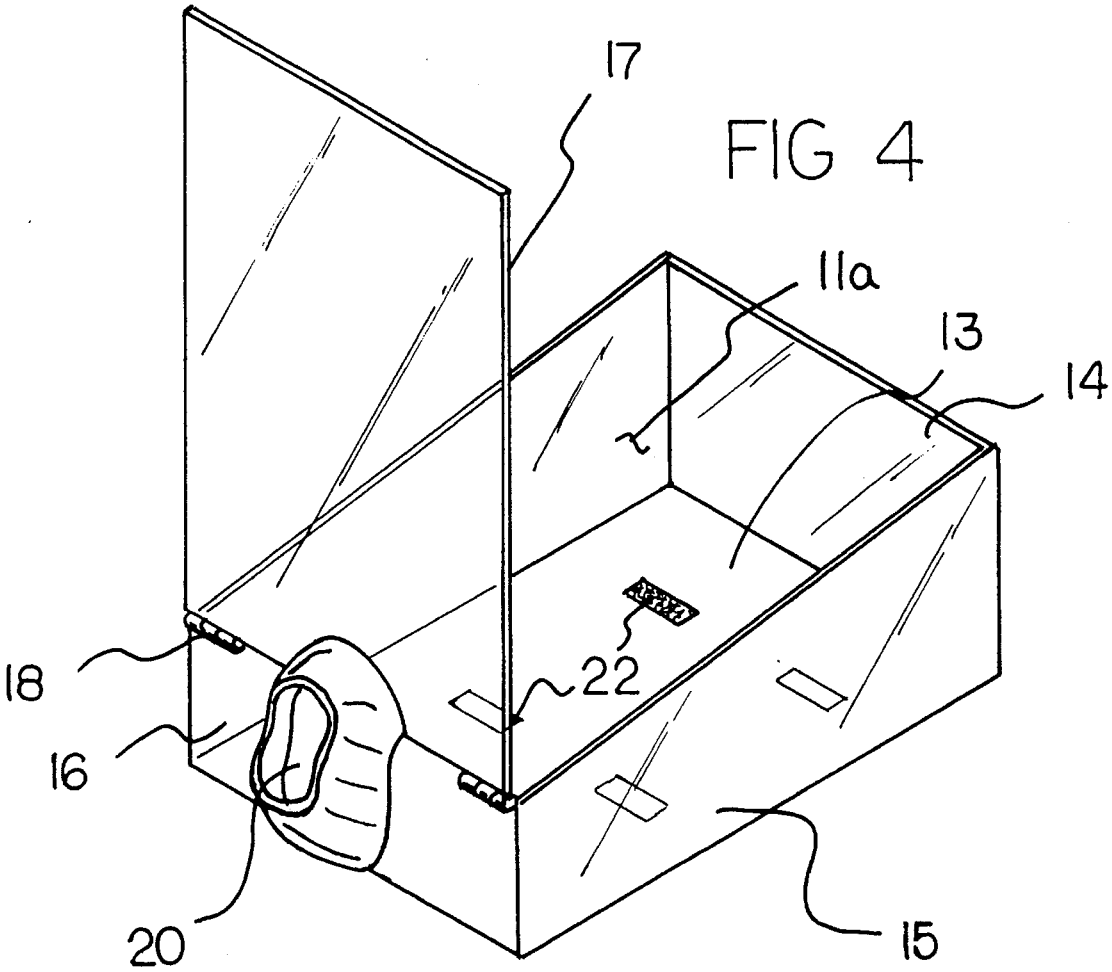
FIG. 4 is an isometric illustration of the invention with the lid opened for access to the interior compartment of the housing.

The weatherproof clipboard assembly 10 of the invention comprises a housing 11 to selectively secure a clipboard 12 therewithin. The housing 11 is formed with a housing floor 13, housing integral walls to include a housing rear wall 14 spaced from a housing front wall 16, as well as spaced housing side walls 15. It should be noted that the housing front wall 16 is a first height as measured from the housing floor 13, with the housing rear wall 14 of a second height greater than the first height, with both heights as noted measured orthogonally relative to the housing floor, such that a lid 17 employing at least one hinge 18 hingedly mounting the lid 17 to the front wall 16 permits greater volumetric capacity within the housing when the lid is closed, as illustrated in FIG. 1, to accommodate an individual's hand that permits ease of manipulation of papers and the associated spring clip 25 that engages the clipboard top wall 26, such as illustrated in FIG. 2. A resilient and elastomeric sleeve 19 is fixedly secured medially of the housing front wall 16, such that the sleeve 19 is formed with a sleeve opening 21 aligned with the front wall opening 20 (see FIG. 7 for example). In this manner, an individual may direct his arm through the sleeve 19, whereupon the sleeve opening 21 engages in a sealing relationship of the individual's arm permitting ease of writing within the housing when the lid 17 is in a closed configuration, as illustrated in FIG. 1, in contiguous communication with the rear wall 14. It should be noted that at least the lid 17 is transparent and desirably, the side walls 15, the front wall 16, and the rear wall 14 should be also of transparent construction to permit not only ease of viewing, but greater light directed into the housing cavity 11*a* of the housing 11.

Figure 5:
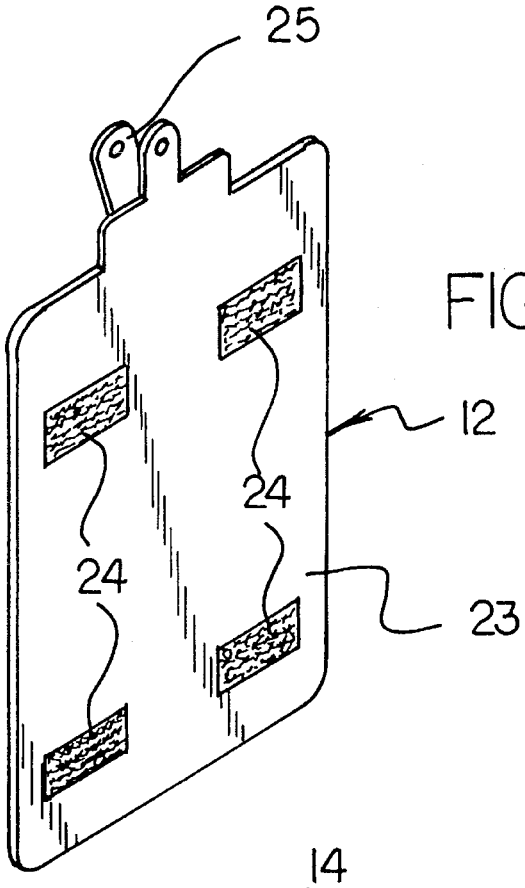
FIG. 5 is an isometric rear view of the clipboard structure.
Figure 6:
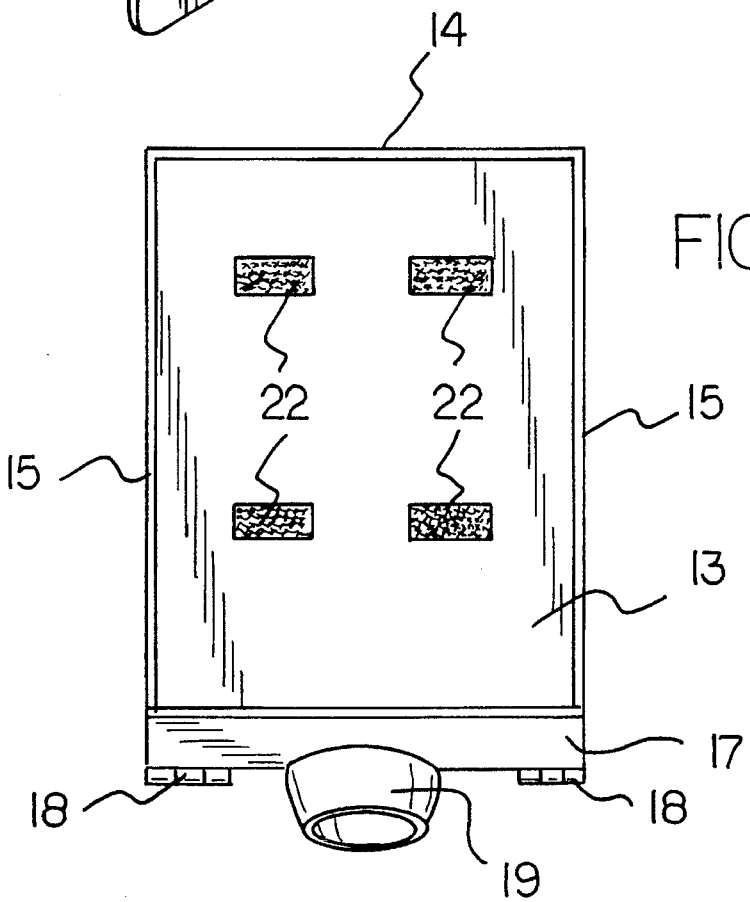
FIG. 6 is an orthographic top view of the housing with the clipboard removed therefrom.

The clipboard 12 is formed with the clipboard bottom wall 23, as illustrated, where it should be noted that the housing floor 13 is formed with first fastener strips 22 facing the housing cavity 11*a*, such that the fastener strips 22 are of a hook and loop fastener construction or may be of a magnetic construction, such that second fastener strips 24 are fixedly secured to the clipboard bottom wall 26 (see FIG. 5) to permit securement of the second fastener strips 24 to the first fastener strips 22 thereby fixedly securing the clipboard within the housing 11 and more specifically onto the housing floor 13. The second fastener strips 24 may also be formed of cooperative hook end loop fastener strips to engage the first fastener strips 22 or may be of a ferrous metallic material to engage magnetic fasteners when the first fastener strips 22 are thusly constructed.

A handle 27 is fixedly secured to the housing floor 13 exteriorly of the housing cavity 11a to permit ease of manual grasping of the housing 11 during a writing procedure. The handle 27 may be configured as an elastomeric strap to thereby adjustably secure an individual's arm or hand to the housing 11 to secure the housing during use.

It is to be understood that while certain forms of the present invention have been illustrated and described herein, it is not to be limited to the specific forms or arrangement of parts described and shown.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed and desired to be protected by Letters Patent of the United States is as follows:

1. A weatherproof clipboard assembly, comprising, a housing, the housing having a housing floor, a housing rear wall, a housing front wall, and spaced housing side walls, wherein the housing floor, the housing rear wall, the housing side walls, and the housing front wall defines a continuous housing wall fixedly secured to the housing floor, and a lid having at least one hinge member, with the hinge member secured to the housing lid and to the housing front wall to pivotally mount the housing lid to the housing front wall, and the front wall having a front wall opening, and an elastomeric sleeve fixedly secured to the housing front wall in surrounding relationship relative to the front wall opening, with the elastomeric sleeve having a sleeve opening aligned with the front wall opening, and a clipboard, and fastening means for securing the clipboard selectively to the housing floor.

2. An assembly as set forth in claim 1 wherein the fastening means includes first fastener strips fixedly secured to the housing floor, and the clipboard having a clipboard bottom wall, with the clipboard bottom wall having second fastener strips arranged for securement to the first fastener strips.

3. An assembly as set forth in claim 2 wherein the housing front wall is formed to have a first height as measured orthogonally relative to the housing floor, with the housing rear wall having a second height as measured from the housing floor, with the second height greater than the first height to provide for ease of hand manipulation within the housing adjacent to the rear wall.

4. An assembly as set forth in claim 3 wherein the sleeve is formed of resilient elastomeric construction.

5. An assembly as set forth in claim 4 with the housing having a housing cavity oriented between the housing floor and the lid, with a handle fixedly secured to the housing floor oriented exteriorly of the housing cavity.

6. An assembly as set forth in claim 5 wherein the handle is formed of elastomeric construction.

7. An assembly as set forth in claim 6 wherein the first fastener strips and the second fastener strips are formed of a cooperative hook and loop fastener material.

8. An assembly as set forth in claim 6 wherein the first fastener strips are of a magnetic material and the second fastener strips are of a ferrous metallic material.

9. An assembly as set forth in claim 6 wherein the lid is transparent.

10. An assembly as set forth in claim 9 wherein the housing side walls, the housing front wall, and the housing rear wall are transparent.

* * * * *